United States Patent [19]

Gorton, Jr. et al.

[11] 4,199,862

[45] Apr. 29, 1980

[54] METHOD OF CONSTRUCTING AN ELECTRICAL WINDING ASSEMBLY

[75] Inventors: William S. Gorton, Jr.; Richard D. Buckley, both of Athens, Ga.

[73] Assignee: Westinghouse Electric Corp., Pittsburgh, Pa.

[21] Appl. No.: 925,084

[22] Filed: Jul. 17, 1978

[51] Int. Cl.[2] ..... H01F 41/12

[52] U.S. Cl. ..... 29/605; 336/205; 427/116; 427/121

[58] Field of Search ..... 29/605; 336/205, 206; 427/116, 121, 375, 385 B, 386, 391

[56] References Cited

U.S. PATENT DOCUMENTS

| | | | |
|---|---|---|---|
| 2,822,483 | 2/1958 | DeJean et al. | 310/45 |
| 2,899,399 | 8/1959 | Flowers | 260/24 |
| 3,352,711 | 11/1967 | Nichols et al. | 427/116 |
| 3,934,332 | 1/1976 | Trunzo | 29/605 |
| 3,939,449 | 2/1976 | Byrd et al. | 336/206 X |

*Primary Examiner*—Carl E. Hall
*Attorney, Agent, or Firm*—D. R. Lackey

[57] ABSTRACT

Electrical winding assembly constructed by (A) winding an electrical conductor into a plurality of radially-spaced layers about an axis, (B) disposing electrical insulating sheet material, which has dry, heat-reactive resin material disposed at discrete areas on at least one side thereof, between the layers of the electrical conductor, (C) applying a slurry formed of solid, heat-reactive resin particles suspended in a non-aqueous liquid carrier, wherein the liquid is chemically inert for the resin particles suspended therein so as not to dissolve or enter into a reaction with the resin, at predetermined locations between certain of the layers of the electrical insulative material and the electrical conductor and (D) heating the electrical winding assembly at a predetermined temperature for a predetermined period of time sufficient to volatize the non-aqueous liquid carrier and to cause the resin on the electrical insulative material and in the slurry to soften and form cohesive bonds between adjacent layers of the electrical insulative material and the electrical conductor as it polymerizes to a solid state.

5 Claims, 2 Drawing Figures

METHOD OF CONSTRUCTING AN ELECTRICAL WINDING ASSEMBLY

BACKGROUND OF THE INVENTION

1. Field of the Invention

This invention relates, in general, to electrical inductive apparatus and, more specifically, to a method of constructing electrical winding assembies for distribution transformers.

2. Description of the Prior Art

In electrical inductive apparatus, such as distribution transformers, it is common to bond the electrical windings together in a solid mass in order to provide sufficient strength to resist the mechanical forces exerted on the windings during normal operation and during extraordinary events, such as short circuits. Although many different types of adhesive and methods for applying the same have been utilized in the prior art, a conventional approach includes the use of a cellulosic sheet material which has a discontinuous coating of a dry, heat-reactive resinous material disposed on at least one side thereof, as shown in U.S. Pat. Nos. 3,237,136, 3,246,271 and 3,974,302, all assigned to the assignee of the present invention. The electrical insulative sheet material is interwoven with an electrical conductor during the construction of an electrical winding assembly such that at least one layer of the insulative sheet material is disposed between adjacent layers of the electrical conductor to provide adequate layer insulation therebetween. The electrical winding assembly is then heated to a predetermined temperature for a predetermined period of time such that the resin material on the insulative sheet material enters a semi-fluid state and flows. Then, the resin permanently sets to bond the layers of the insulative sheet material and the electrical winding together in a solid mass.

The recent trend in electrical distribution systems towards higher distribution voltages requires transformers which are capable of operating reliably at the higher distribution voltages. The higher distribution voltages and ratings necessarily increase the mechanical forces acting upon the various parts of the electrical winding of the transformer and, in particular, increase the forces acting upon the insulation space between the high and low voltage windings. Thus, it would be desirable to add additional amounts of adhesive in these areas to provide an electrical winding assembly having increased mechanical strength to resist the larger mechanical forces acting thereon and, especially, the forces occurring during a short circuit. In addition, voids formed within the resinous material as it is cured, that could be tolerated at lower voltages, create problems at the higher voltages by leading to unacceptable levels of corona and radio interference.

There are several known methods of applying resinous compositions to electrical members. One conventional approach, as shown in U.S. Pat. No. 3,451,934, is to dissolve the resinous composition in some readily volatile solvent or solvents for the purpose of simplifying the application of the resinous composition to the electrical apparatus. These solvents, which are generally low or medium boiling point liquids and not capable of entering into reaction with the resin, are removed from the resinous composition during curing by evaporation of the solvent. However, the resins generally employed have poor solvent release characteristics and thereby tend to trap portions of the solvent in the thicker deposits of resin as the resin cures to a solid state. The trapped solvent evaporates and forms voids within the solid resinous composition which trap air and leads to corona and radio interference in the electrical apparatus. It is also known to employ reacting solvents with the resinous composition in which the solvents are characterized by the fact that they enter into a polymerizing reaction with the dissolved resin. These solvent reactive resin compositions, or so-called "solventless" compositions, as disclosed in U.S. Pat. Nos. 2,484,215, 2,464,568 and 3,182,383, employ no evaporable solvent which thereby reduces the void problem associated with solvent based resinous compositions. However, these compositions are typically quite expensive for application in the electrical apparatus.

Solvent-free resinous compositions, as shown in U.S. Pat. No. 3,867,758, in which a resin is held in a water or air suspension, are also known. However, the use of a water-based composition lacks good consistency for ease of application and, further, wets and warps the cellulosic sheet material used in electrical transformers, thereby degrading the electrical characteristics of the transformer.

Thus, it is desirable to provide an electrical winding assembly for an electrical inductive apparatus, such as a distribution transformer, which has increased mechanical strength to withstand the mechanical forces acting upon the windings during extraordinary events, such as short circuits. It is also desirable to provide an electrical winding assembly wherein increased mechanical strength is obtained by the application of additional amounts of adhesive to predetermined areas within the electrical winding assembly. Finally, it is desirable to provide an electrical winding assembly which has reduced levels of corona and radio interference over similar apparatus constructed according to the prior art.

SUMMARY OF THE INVENTION

In general, the present invention comprises a method of constructing an electrical winding assembly for an electrical inductive apparatus, such as a transformer, wherein increased mechanical strength is provided by the use of additional amounts of adhesive applied at predetermined locations within the electrical winding assembly and, further, wherein corona and radio interference levels associated with such apparatus are minimized.

more specifically, the electrical winding assembly is constructed by (A) winding an electrical conductor into a plurality of radially-spaced layers about an axis, (B) disposing electrical insulating sheet material, which has dry, heat-reactive resin disposed at discrete areas on at least one side thereof, between the layers of the electrical conductor, (C) applying a slurry formed of solid, heat-reactive resin particles suspended in a non-aqueous liquid carrier, wherein the liquid carrier is chemically inert for the resin particles suspended therein so as not to dissolve or enter into a reaction with the resin, at predetermined locations between certain of the layers of the electrical insulating material and the electrical conductor and (D) heating the electrical winding assembly at a predetermined temperature for a predetermined period of time sufficient to volatize the non-aqueous liquid carrier and to cause the resin on the electrical insulating material and in the slurry to initially soften and form cohesive bonds, as it polymerizes to a solid state, between adjacent layers of the electrical insulative material and the electrical conductor.

The use of additional amounts of adhesive at predetermined locations within the electrical winding assembly through the application of the above-described slurry provides increased mechanical strength for the electrical winding assembly since the slurry is applied at those locations where the mechanical forces and electrical stresses are greatest, such as in the insulation space between the high and low voltage windings of a transformer. In addition, upon curing, the slurry enables strong, void-free bonds to be produced between adjacent layers of the electrical conductor and the electrical insulating material. Since the heat-reactive resin particles are suspended, and not dissolved, in the non-aqueous, liquid carrier, the vapors of the non-aqueous liquid easily flow around the resin particles during the curing process which prevents the formation of voids or bubbles within the solidified resin. The elimination of these voids, which may trap air, significantly reduces the corona and radio interference levels of the electrical winding assembly compared to similar electrical windings bonded with conventional solvent-based resin solutions.

The non-aqueous liquid carrier is formed of a substantially aliphatic hydrocarbon distillate of petroleum having a boiling point range between about 150° C. and 300° C. and, more preferably, of refined kerosine containing primarily aliphatic hydrocarbon molecules from $C_{12}$ to $C_{14}$ and having a boiling point range between 200° C. and 250° C. These materials are chemically inert with the particular resins utilized and, further, have a boiling point higher than the normal polymerizing temperature of the resin and the winding baking temperature such that the carrier vaporizes, but does not boil, and escapes from the electrical apparatus as the resin enters a semifluid state thereby minimizing the formation of voids with the resin.

BRIEF DESCRIPTION OF THE DRAWING

The various features, advantages and additional uses of this invention will become more apparent by referring to the following detailed description and the accompanying drawing, in which.

DESCRIPTION OF THE PREFERRED EMBODIMENT

Figure 1:
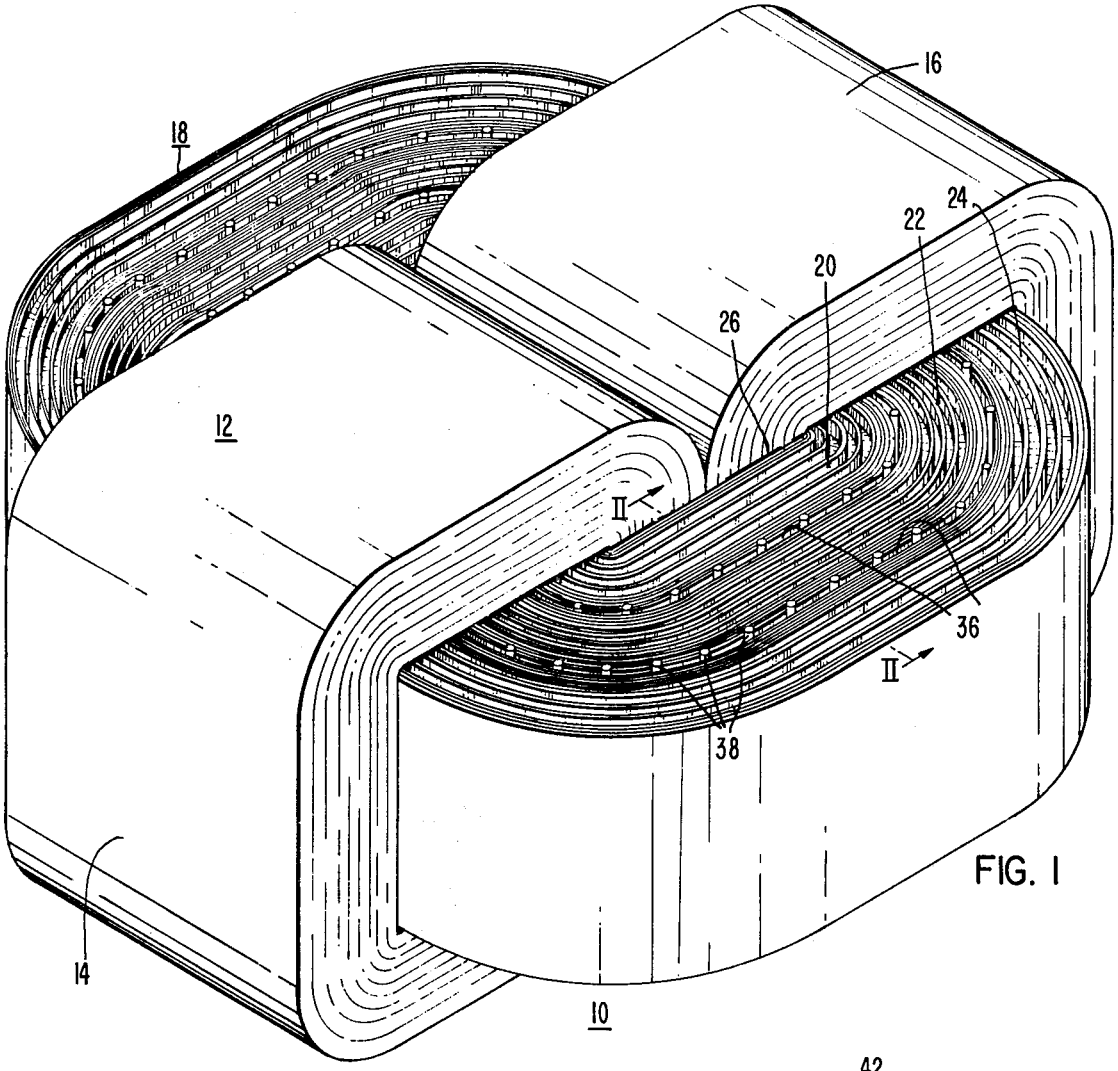
FIG. 1 is a perspective view of an electrical transformer having an electrical winding assembly constructed according to the teachings of this invention.

Throughout the following description, identical reference numbers refer to the same component or member shown in all figures of the drawing.

Referring now to the drawing, and to FIG. 1 in particular, there is shown a transformer 10 constructed according to the teachings of this invention. The transformer 10 is constructed of components suitable for distribution transformers and may be placed in a suitable tank enclosure, not shown, containing a dielectric coolant fluid, such as mineral oil.

The transformer 10 includes a magnetic core and electrical winding assembly 12 consisting of an electrical winding assembly 18 which is disposed in inductive relation with magnetic cores 14 and 16. Although the magnetic cores 14 and 16 are depicted as being formed of wound laminations of magnetic material, other types of core construction may also be used within the teachings of this invention.

The electrical winding assembly 18 includes an inner low-voltage winding section 20, a high-voltage winding section 22 and an outer low-voltage winding section 24 each of which form a plurality of layers about a central axis. The winding assembly 18 contains an opening 26 through which the magnetic cores 14 and 16 extend. Although not shown, the winding sections 20, 22 and 24 have leads extending therefrom to permit electrical connection to each other or to other electrical apparatus. Furthermore, although a split low-voltage winding configuration is illustrated, it will be apparent that other electrical winding assembly constructions, such as those including a single high voltage and a single low voltage winding, may also be constructed according to the teachings of this invention, as described hereafter.

Figure 2:
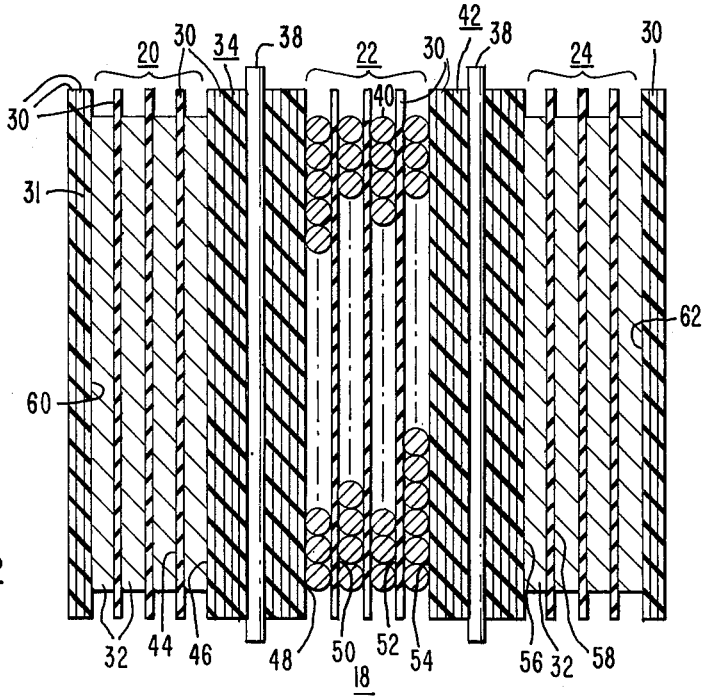
FIG. 2 is a sectional view, generally taken along line II—II in FIG. 1, depicting the detailed construction of the electrical winding assembly.

Referring now to FIG. 2, there is shown a cross-sectional view of the electrical winding assembly 18. As shown therein, the electrical winding assembly 18 includes a plurality of layers of an electrically insulating sheet material 30 which are built up to a thickness 31 to provide sufficient electrical insulation between the inner low-voltage winding 20 and the magnetic cores 14 and 16. According to the preferred embodiment of this invention, the electrically insulating sheet material 30 is formed of thermally stabilized, cellulosic insulating paper having a discontinuous coating of an adhesive, such as an epoxy resin, which is in the "B" stage, on at least one side thereof. The B-stage resin is dry at ambient temperatures but enters a semi-fluid state and flows at elevated temperatures and then becomes permanently set to form strong, cohesive bonds between adjacent layers of the insulative paper 30.

The inner low-voltage winding section 20 comprises a plurality of layers of an electrical conductor 32 and electrical insulative sheet material 30 positioned around the magnetic cores 14 and 16. The electrical conductor 32 may be formed of any suitable electrically conductive material, such as copper or aluminum, and may be in the form of wire strands, strip, foil sheets or any other form suitable for electrical apparatus of this type. According to the preferred embodiment of this invention, the electrical conductor 32 in the low-voltage winding section 20 is formed of strip material to essentially eliminate vertical displacement of the winding due to forces incident to a short circuit. An electrically insulating sheet material 30, having a discontinuous pattern of B-stage resin disposed on at least one side thereof, is wound with the electrical conductor 32 during the construction of the low-voltage winding section 20 to provide the necessary layer insulation between adjacent, radially spaced layers of the electrical conductor 32. It is apparent that the number of layers of the electrical conductor 32 utilized to form the low voltage winding section 20 as well as the thickness of the strip material used to form the low-voltage conductor 32 and the total thickness of the electrically insulative sheet material disposed therebetween will vary depending upon the current and voltage requirements of a particular application.

Addition layers of the electrically insulating sheet material 30 are disposed around the inner low-voltage winding section 20 to a predetermined thickness sufficient to provide adequate insulation in the clearance or gap 34 between the inner low-voltage winding section 20 and the high-voltage winding section 22. In addition, a plurality of fluid flow passages 36, shown in FIG. 1, are provided between the inner low-voltage section 20 and the high-voltage winding section 22 to allow fluid coolant to flow between the insulation layers and thereby cool the electrical winding assembly 18. The fluid flow passages 36 are formed by a plurality of spaced, vertically-extending spacers 38 which are joined to one of the layers of the insulating sheet material 30 and thereby form the cooling passages 36 around at least a portion of the electrical winding assembly 18 as the insulative sheet material 30 is wound around the low voltage winding section 20.

The high-voltage winding section 22 is wound around the clearance or so-called high-low space 34. The high-voltage winding section 22 comprises a plurality of layers of a suitable electrical conductor 40 which may be constructed of round or rectangular wire strands, sheets or any other form suitable for apparatus of this type. According to the preferred embodiment of this invention, the electrical conductor 40 which forms the high-voltage winding section 22 is constructed of round wire which is covered with a thin coat of a suitable insulative material, such as enamel, to provide the necessary insulation between adjacent turns of the electrical conductor 40. In addition, layers of the electrically insulative sheet material 30 are disposed between adjacent layers of the conductor 40 in the high-voltage winding section 22 to provide sufficient layer insulation therebetween.

The outer high-low space 42 is formed by winding a plurality of layers of the electrically insulative sheet material 30 around the high voltage winding section 22 to a predetermined buildup or thickness in order to provide the necessary insulation between the high-voltage winding section 22 and the outer low voltage winding section 24. In addition, a plurality of spaced, vertically-extending spacers 38 are disposed between adjacent layers of the insulative material 30 in the high-low space 42 to form fluid flow passages 36 therebetween to allow fluid coolant to flow between the high-voltage winding section 22 and the outer low-voltage winding section 24.

The outer low-voltage winding section 24 is formed in an identical manner as the inner low-voltage winding section 20 and includes a plurality of layers of an electrical conductor 32 wound around the insulative sheet material 30 in the outer high-low space 42. As in the inner low-voltage winding section 30, layers of electrically insulative sheet material 30 are disposed between adjacent layers of the electrical conductor 32 in the outer low-voltage winding section 24 provide sufficient layer insulation therebetween. Additional layers of the electrically insulative sheet material 30 are disposed around the outer low-voltage winding section 24 to complete the electrical winding assembly 18.

After the electrical winding assembly 18 is wound, it is heated at a predetermined temperature for a predetermined period of time to cure the resin material on the electrical insulative sheet material 30. In order to cure the particular epoxy resin utilized on the electrically insulative sheet material 30, the electrical winding assembly 18 is heated to 145° C. for four hours. During this time, the resin on the insulative paper 30 enters a semi-fluid state and flows between adjacent layers of the insulative paper 30 and the electrical conductors in the various winding sections. The resin, then, polymerizes to a solid state to form cohesive bonds between the layers of the conductors in the various winding sections and the adjoining layers of the insulative sheet material.

The recent trend towards distribution transformers having higher ratings and operating at higher voltages and currents increases the electrical stresses and mechanical forces occurring at certain locations within the electrical winding assembly under normal operation and during extraordinary events, such as a short circuit. These areas generally include the inner and outer high-low spaces 34 and 42, respectively, which are subject to the greatest mechanical forces and electrical stresses within the electrical winding assembly 18. In order to construct an electrical winding assembly having sufficient mechanical strength to operate at the desired higher ratings and voltages, it is necessary to add additional amounts of adhesive at these locations. It is the purpose of this invention to provide a method wherein additional amounts of a suitable adhesive are added to the desired locations within the electrical winding assembly in a novel and unobvious manner to provide increased mechanical strength such that the electrical winding assembly may reliably operate at the desired higher voltages and ratings, and further, will withstand any short circuits that may occur.

According to this invention, the additional amounts of adhesive are added in the form of a slurry. The slurry is formed of solid, heat-reactive resin particles suspended in a non-aqueous liquid carrier which is chemically inert for the particular resin utilized such that the resin particles are not dissolved in the non-aqueous liquid carrier as is common with conventional solvent-based resin solutions. As the resin is cured, the non-aqueous liquid is free to evaporate and flow around the solid resin particles thereby reducing the possibility of trapping small amounts of the non-aqueous liquid within the thicker deposits of the resin as the resin polymerizes to a solid state. In conventional solvent-based resinous solutions, small amounts of the solvent are trapped within the resin as it cures which form voids as the solvent evaporates that may trap air and result in corona and radio interference within the electrical winding assembly of the transformer.

Many types of resins known in the art are suitable for use in the slurry and include epoxy resins, polyester resins, polyurethane resins, polyacrylic resins and phenolic resins. All of these resins have the required properties of being able to be B-staged in that they are dry and non-tacky at normal room temperatures, but are capable of softening and flowing at elevated temperatures and forming strong bonds as they polymerize to a solid state. Since an epoxy resin is typically used on the insulative sheet material, an epoxy resin is preferred for use in the slurry.

The non-aqueous liquid carrier used to form the slurry must be substantially chemically inert with the particular resin utilized. The term "chemically inert" is meant to include materials which are non-solvents for the particular resins utilized so as not to dissolve the resin particles and, further, materials which are substantially non-reactive with the resin. The non-aqueous liquid carrier must also have an initial boiling point higher than the normal polymerizing or curing temperature range of the resin and the winding baking temperature such that substantially all of the non-aqueous liquid carier vaporizes and escapes from the apparatus as the resin enters a semi-fluid state. This is necessary to insure that small amounts of the non-aqueous liquid carrier are not trapped in the thicker deposits of resin as the resin polymerizes to a solid state.

it has been found that materials having the necessary characteristics of being chemically inert with the resins previously listed and having an initial boiling point higher than the normal polymerizing temperature range of the resins and the winding baking temperature generally include the substantially aliphatic hydrocarbon distillation products of petroleum which have a boiling point range between about 150° C. and about 300° C. These hydrocarbon products, such as kerosine, are chemically inert with the resins utilized in this invention and also have their initial boiling points higher than the normal polymerizing temperature range of the resin, such as the 145° C. curing temperature for the epoxy resin utilized in the slurry and on the sheets of electrical insulative material. During the curing process, the non-aqueous liquid carrier vaporizes, but does not boil, and flows around the resin particles in the slurry thereby escaping from the slurry as the resin particles enter a semi-fluid state.

In particular, it has been found that one distillation product of petroleum, known as refined kerosine, which contains primarily aliphatic hydrocarbon molecules from $C_{12}$ to $C_{14}$ and has a boiling point range between about 200° C. and about 250° C., is especially useful as a non-aqueous liquid carrier for the slurry. It is known that the exact composition of refined kerosine will vary depending upon the source of the petroleum from which it is distilled and could include small percentages of higher molecular weight hydrocarbon molecules, such as naphtha or aromatic hydrocarbons; as well as small percentages of lower molecular weight hydrocarbon molecules, such as light fuel oils. Preferably the refined kerosine utilized to form the slurry should include 90 to 95% aliphatic, straight carbon chain, molecules having from 12 to 14 carbon atoms each.

According to the preferred embodiment of this invention, the slurry is formed by mixing one pound of B-staged epoxy resin powder in one pound of refined kerosine. This mixture has a good consistency for ease of application and, further, possesses excellent handling and shelf life characteristics. When the slurry is applied to the desired areas within the electrical winding assembly, as described hereafter, the kerosine soaks into the electrically insulative cellulosic sheet material with the resin powder remaining on the surface thereof. In this manner, the cellulosic paper adjacent to a fused resin bond remains open to oil impregnation. During cure, the resin powder softens and flows between adjacent surfaces of the electrically insulative sheet material and the electrical conductors and forms strong cohesive bonds therebetween as it polymerizes to a solid state. Also, the kerosine evaporates during the curing process, with the vapors thereof escaping around the resin particles without being trapped in the thicker deposits of the resin as the resin cures to a solid state. Thus, voids within the resin are minimized which reduces corona and radio interference levels within the electrical winding assembly compared to electrical winding assemblies utilizing conventional solvent-based adhesives.

In order to provide an electrical winding assembly having increased mechanical strength, the slurry is applied, preferably by brushing, although any suitable application means may be utilized, to those areas subject to the greatest mechanical forces and electrical stresses during the operation of the transformer. As previously noted, these areas generally include the high-low spaces 34 and 42 and the adjacent portions of the winding sections 20, 22 and 24. In each instance, the slurry is uniformly applied over the surface of either the electrical conductor or the electrically insulative sheet material as the two are being wound together to form the electrical winding assembly. According to the preferred embodiment of this invention, the slurry is applied to the outer two layers of the inner low-voltage winding section 20, as noted at locations 44 and 46, the innermost two layers of the high-voltage winding section 22, at locations 48 and 50, the outermost two layers of the high-voltage winding section 22 at locations 52 and 54, and the inner two layers of the outer-voltage winding section 24 at locations 56 and 58. In addition, the slurry may be applied to the innermost turn of the inner low-voltage winding section 20 at location 60 and to the outermost turn of the outer low-voltage winding section 24, as noted at location 62. The slurry is also applied to all the spacers 38 in the inner and outer high-low spaces 34 and 42.

Typically, the spacers 38 comprise cylindrical sticks, having a square, round or rectangular cross-section and formed of an electrically insulating material, which are bonded to one side of the electrically insulative sheet material 30 for ease of handling and application. Further, a coating of a solvent-based B-staged epoxy resin is generally applied to the exposed surface of the assembled spacers 38 prior to assembly with the winding to improve the bond between the spacers 38 and the adjoining electrically insulative sheet material after the spacers 38 and the sheet material 30 are wound together during the construction of the electrical winding assembly 18. The application of the above-described slurry over the exposed surface of the spacers 38 provides increased strength without formation of voids since the non-aqueous liquid carrier utilized in the slurry easily escapes from the resin during the curing process thereby reducing the formation of voids within the solidified resin and significantly reducing the corona and radio interference levels within the electrical winding assembly.

The advantages provided by the use of the novel slurry of this invention are shown in the results of corona, radio interference and telescoping tests made on several electrical winding assemblies utilizing the novel slurry of this invention and conventional solvent-based epoxy resin solutions. In performing the tests, three identical electrical winding assemblies utilized the novel slurry of this invention; while one electrical winding assembly utilized an epoxy varnish formed of a catalyzed epoxy resin dissolved in an acetone solvent and another electrical winding assembly utilized the same catalyzed epoxy resin dissolved in a differrent solvent.

Corona tests were performed on each of the five electrical winding assemblies on conventional corona test equipment at 60 Hz over a range of voltages. The results of the corona tests are summarized in Table I.

TABLE I

| | Corona (in picocoulombs) | | | | |
|---|---|---|---|---|---|
| Winding Assembly | 8kV | 15kV | 20kV | 23kV | 30kV |
| 1 - Powder Slurry | 0 | 0 | 0 | 0 | 0 |
| 2 - Powder Slurry | 0 | 0 | 0 | 0 | 0 |
| 3 - Powder Slurry | 0 | 0 | 20 | 74 | 150 |
| 4 - Epoxy resin acetone solution | 0 | 100 | 320 | 1600 | 1840 |
| 5 - Solvent based epoxy resin | | | | | |

TABLE I-continued

| Winding Assembly | Corona (in picocoulombs) 8kV | 15kV | 20kV | 23kV | 30kV |
|---|---|---|---|---|---|
| solution | 0 | 150 | 700 | 900 | 1200 |

It is evident that the corona levels are significantly lower in the powder slurry electrical winding assemblies than in the electrical winding assemblies utilizing conventional solvent-based epoxy resin solutions. In particular, winding assemblies 1 and 2 were free from measurable corona up to the maximum test voltage of 30 kV. It is felt that the conventional solvent-based epoxy resin solutions form voids in heavier deposits of resin from trapped amounts of solvent which are the source of ionization in critical locations of the electrical winding assemblies.

Radio interference tests were also conducted on the same electrical winding assemblies at 1 megahertz over the same voltage range on conventional test equipment.

TABLE II

| Winding Assembly | Radio Interference (in microvolts) 8kV | 15kV | 20kV | 23kV | 30kV |
|---|---|---|---|---|---|
| 1 - Powder Slurry | 0 | 0 | 2 | 3 | 3–75 |
| 2 - Powder Slurry | 0 | 0 | 0 | 0 | 0 |
| 3 - Powder Slurry | 0 | 0 | 4.7 | 900 | 1140 |
| 4 - Expoxy resin - acetone solution | 0 | 94 | 165 | 188 | 564 |
| 5 - Solvent based epoxy resin solution | 0 | 28 | 376 | 423 | 658 |

The results of the radio interference are summarized in Table II and show the radio interference levels to be noticeably lower for electrical winding assemblies utilizing the novel powder slurry of this invention than windings using conventional solvent based epoxy resin solutions. It is felt that the high radio interference levels in electrical winding assembly 3 resulted from voids formed in the adhesive used to initially bond the spacers to the electrically insulated sheet material prior to assembly with the conductor.

Tests were also performed on each electrical winding assembly to determine the force required to telescope the windings along the high-low space as this is the normal mode of failure during a short circuit.

TABLE III

| Specimen | Force at Failure (lbs.) Inner Hi-Lo Space | Outer Hi-Lo Space |
|---|---|---|
| 1 - Powder Slurry | 862 | 768 |
| 2 - Powder Slurry | 980 | 1130 |
| 3 - Powder Slurry | 1060 | 760 |
| 4 - Expoxy resin-acetone solution | 840 | 2280 |
| 5 - Solvent based epoxy resin | 1290 | 2420 |

In the case of the telescoping tests on the inner high-low space of 34, as shown in Table III, there is little variation in the force at failure between the various electrical winding assemblies. Failure generally occurred in the high-voltage coils, by telescoping of the paper near the spacer in the high-low space or by telescoping of the inner low-voltage winding. The results of the telescoping tests on the outer high-low space 42 show that the strength of the solvent based epoxy resin solutions is higher than that of the powder slurry bonded electrical winding assemblies. The modes of failure are quite different, however, with the solvent based windings failing in the spacer area and the powder slurry bonded windings failing within the high-voltage winding section.

it will be apparent to one skilled in the art that there is disclosed herein a novel and unobvious method for construction an electrical winding assembly for an electrical inductive apparatus which has sufficient mechanical strength to resist the forces exerted on the electrical winding assembly at the higher ratings and voltages desired for apparatus of this type and also during extraordinary events, such as short circuits. The increased mechanical strength is provided by the use of additional amounts of adhesive which are applied to certain areas of the electrical assembly, such as the high-low spaces between the high-voltage and low-voltage windings and, also, between the layers of the high and low voltage windings adjacent to the high-low spaces. According to the teachings of this invention, the additional amounts of adhesive are applied to the desired locations within the electrical winding assembly in the form of a slurry in which solid, heat-reactive resin particles are suspended in a non-aqueous liquid carrier which is chemically inert for the particular resin utilized so as to not dissolve the resin therein. The non-aqueous liquid carrier evaporates during the curing process without being trapped beneath the resin as the resin cures to a solid state as commonly occurs in prior art apparatus utilizing solvent based resin solutions, thereby reducing the formation of voids within the solidifed resin which, in turn, significantly reduces the corona and radio interference levels in an electrical winding assembly constructed according to the teachings of this invention.

We claim:

1. A method of constructing an electrical winding assembly comprising the steps of:

winding an electrical conductor into a plurality of radially-spaced layers about a central axis;

disposing an electrical insulating material between at least certain of said layers of said electrical conductor;

applying a slurry, formed of solid, heat-reactive resin particles suspended in a non-aqueous liquid carrier comprising a substantially aliphatic hydrocarbon distillate of petroleum having a boiling point range between about 150° C. and about 300° C., which carrier is chemically inert with said resin particles and which has a boiling point higher than the normal polymerizing temperature range of said resin particles such that substantially all of said non-aqueous liquid carrier vaporizes, but does not boil, as said resin particles polymerize to a solid state, between certain of said layers of said electrical conductor and said electrical insulating material; and heating said electrical winding assembly at a predetermined temperature for a predetermined period of time sufficient to volatize said non-aqueous liquid carrier and to cause said resin particles to soften and flow between adjoining layers of said electrical conductor and said electrical insulating material and form cohesive bonds therebetween as said resin particles polymerize to a solid state.

2. The method of claim 1 wherein the non-aqueous liquid carrier is refined kerosine containing primarily aliphatic hydrocarbon molecules from $C_{12}$ to $C_{14}$ and having a boiling point range between about 200° C. and about 250° C.

3. The method of claim 1 wherein the resin particles are selected from a group consisting of epoxy resins, polyester resins, polyacrylic resins, polyurethane resins and phenolic resins.

4. The method of claim 1 wherein the electrical insulating material is formed of cellulosic material having dry, heat-reactive adhesive material disposed at discrete areas on at least one side thereof.

5. A method of constructing an electrical winding assembly for an electrical transformer comprising the steps of:

forming a first electrical winding by interleaving layers of a first electrical conductor and an electrically insulating sheet material about a central axis with said electrical insulating sheet material having dry, heat-reactive resin material disposed at descrete areas on at least one side thereof;

winding at least one layer of said electrically insulating sheet material around said first electrical winding, with said electrical insulating sheet material having a plurality of spaced, axially extending spacers bonded to one side thereof;

forming a second electrical winding by winding interleaved layers of a second electrical conductor and layers of said electrical insulating sheet material around said layer of said insulating sheet material surrounding said first electrical winding;

applying a slurry, formed of solid, heat-reactive B-staged epoxy resin particles suspended in a non-aqueous liquid carrier refined kerosine having a boiling point range between about 200° C. and about 250° C., which carrier is chemically inert with said resin particles and which has a boiling point higher than the normal polymerizing temperature range of said resin particles, between at least certain of said layers of said first and second electrical conductors and said electrical insulating sheet material in said first and second electrical windings and on said spacers bonded to said layer of electrical insulating material surrounding said first electrical winding; and heating said electrical winding assembly at a predetermined temperature for a predetermined period of time sufficient to volatize said non-aqueous liquid carrier and to cause said resin particles on said electrical insulating sheet material and said resin particles suspended in said non-aqueous liquid carrier to soften and flow between adjacent layers of said first and second electrical conductors and said electrical insulating sheet material and form cohesive bonds therebetween as said resin polymerizes to a solid state.

* * * * *